US011326278B2

(12) United States Patent
Koo

(10) Patent No.: US 11,326,278 B2
(45) Date of Patent: May 10, 2022

(54) FABRIC CONSTRUCTIONS WITH HOLLOW STRUCTURES

(71) Applicant: Kam Cheung Koo, Hong Kong (CN)

(72) Inventor: Kam Cheung Koo, Hong Kong (CN)

( * ) Notice: Subject to any disclaimer, the term of this patent is extended or adjusted under 35 U.S.C. 154(b) by 0 days.

(21) Appl. No.: 16/933,406

(22) Filed: Jul. 20, 2020

(65) Prior Publication Data

US 2020/0378039 A1 Dec. 3, 2020

Related U.S. Application Data

(63) Continuation-in-part of application No. 16/211,230, filed on Dec. 6, 2018, now abandoned.

(30) Foreign Application Priority Data

Sep. 20, 2018 (CN) ..... 201811097773.0

(51) Int. Cl.
*D02G 3/32* (2006.01)
*D03D 15/00* (2021.01)
(Continued)

(52) U.S. Cl.
CPC ..... *D02G 3/326* (2013.01); *D02G 3/44* (2013.01); *D03D 15/47* (2021.01); *D03D 15/56* (2021.01); *D06B 9/00* (2013.01); *D06M 11/05* (2013.01); *D02G 3/32* (2013.01); *D06M 2101/06* (2013.01); *D06M 2101/24* (2013.01); *D06M 2101/38* (2013.01); *D10B 2201/24* (2013.01); *D10B 2321/06* (2013.01); *D10B 2331/10* (2013.01); *D10B 2401/024* (2013.01); *D10B 2401/061* (2013.01)

(58) Field of Classification Search
CPC D02G 3/326; D02G 3/44; D02G 3/32; D03D 15/47; D03D 15/56; D06M 11/05; D06M 2101/06; D06M 2101/38; D06M 2101/24; D06B 9/00; D10B 2321/06; D10B 2401/061; D10B 2201/24; D10B 2331/10; D10B 2401/024
See application file for complete search history.

(56) References Cited

U.S. PATENT DOCUMENTS 3,121,698 A 2/1964 Osino et al.
3,357,076 A 12/1967 Greenwald et al.
(Continued)

FOREIGN PATENT DOCUMENTS

CN 106835414 A 6/2017

OTHER PUBLICATIONS

Machine Translation of CN 106835414 to Jinzhang, Jun. 2017. (Year: 2017).*
Machine Translation of CN 106835414 to Jinzhang, Jun. 2017.

*Primary Examiner* — Benjamin L Osterhout
(74) *Attorney, Agent, or Firm* — BakerHostetler

(57) ABSTRACT

Techniques for producing an article having hollow structures are described herein. The disclosed techniques include weaving a plurality of yarns to form a woven fabric, wherein the plurality of yarns each comprise a dissolvable core, and the dissolvable core comprises polyvinyl alcohol (PVA) having a water solubility; neutralizing an alkaline before drying the woven fabric to maintain the water solubility of the PVA; and washing the woven fabric or a garment made by the woven fabric to at least partially remove the dissolvable core.

20 Claims, 3 Drawing Sheets

(51) Int. Cl.

| | |
|---|---|
| ***D06B 9/00*** | (2006.01) |
| ***D06M 11/05*** | (2006.01) |
| ***D02G 3/44*** | (2006.01) |
| ***D03D 15/47*** | (2021.01) |
| ***D03D 15/56*** | (2021.01) |
| *D06M 101/38* | (2006.01) |
| *D06M 101/06* | (2006.01) |
| *D06M 101/24* | (2006.01) |

(56) References Cited

U.S. PATENT DOCUMENTS

| | | | | |
|---|---|---|---|---|
| 3,412,547 | A | 11/1968 | Martin | |
| 3,853,687 | A | 12/1974 | Ishikawa et al. | |
| 5,604,012 | A | 2/1997 | Okamoto et al. | |
| 9,260,803 | B2 | 2/2016 | David et al. | |
| 9,677,201 | B2 * | 6/2017 | Mandawewala | D03D 15/258 |
| 2005/0106391 | A1 | 5/2005 | Lawrence et al. | |
| 2009/0068463 | A1 | 3/2009 | Mochizuki et al. | |
| 2009/0139601 | A1 | 6/2009 | Karayianni et al. | |
| 2011/0308707 | A1 | 12/2011 | Montoya | |
| 2012/0097604 | A1 | 4/2012 | Cote et al. | |
| 2012/0273409 | A1 | 11/2012 | Seo et al. | |
| 2012/0322332 | A1 | 12/2012 | Paulauskas et al. | |
| 2013/0168007 | A1 | 7/2013 | Cote et al. | |
| 2014/0103583 | A1 | 4/2014 | Pham et al. | |
| 2015/0104990 | A1 | 4/2015 | Mandawewala | |
| 2015/0284881 | A1 | 10/2015 | Yu et al. | |
| 2016/0184777 | A1 | 6/2016 | Cote et al. | |
| 2018/0347077 | A1 * | 12/2018 | Goenka | D02G 3/36 |

* cited by examiner

FABRIC CONSTRUCTIONS WITH HOLLOW STRUCTURES

CROSS REFERENCE TO RELATED APPLICATION

The present application is a continuation-in-part of U.S. patent application Ser. No. 16/211,230, filed Dec. 6, 2018, which claims priority to Chinese Patent Application No. 201811097773.0, filed Sep. 20, 2018, the entire contents of which are hereby incorporated by reference.

BACKGROUND

Fabric construction involves the conversion of yarns into a fabric having characteristics determined by the materials and methods employed. Most fabrics are presently produced by some method of interlacing, such as weaving or knitting. Weaving is a widely used constructional method because woven fabrics are more durable, higher fabricability, better shape stability as well as stronger, higher twist per inch yarn compared with knit fabrics. Woven fabrics have valuable characteristics resulting partly from the geometrical conformation of their components and partly from the fact that the components are held in position not by rigid bonding but by inter crossing of yarns. Woven fabrics are used in apparel, household, and industrial textiles.

BRIEF DESCRIPTION OF DRAWINGS

The following detailed description may be better understood when read in conjunction with the appended drawings. For the purposes of illustration, there are shown in the drawings example embodiments of various aspects of the disclosure; however, the invention is not limited to the specific embodiments disclosed.

DETAILED DESCRIPTION

The present disclosure describes techniques for producing an article having hollow structures. In accordance with the present disclosure, a woven fabric is formed by weaving a plurality of yarns comprising dissolvable cores including polyvinyl alcohol (PVA) with water solubility. To maintain the water solubility of the PVA, an alkali is neutralized before any process of drying the woven fabric. The dissolvable cores are removed by washing the woven fabric or a garment made by the woven fabric.

The present disclosure also provides an article having hollow structures. In accordance with the present disclosure, the article comprises a plurality of yarns having dissolvable cores. The dissolvable cores include PVA maintaining its water solubility until the PVA dissolvable cores are removed by washing the woven fabric or the garment made by the woven fabric. The article provided in accordance with the present disclosure has a lighter weight and its air permeability, resilience, and comfortableness are significantly improved.

Figure 1:
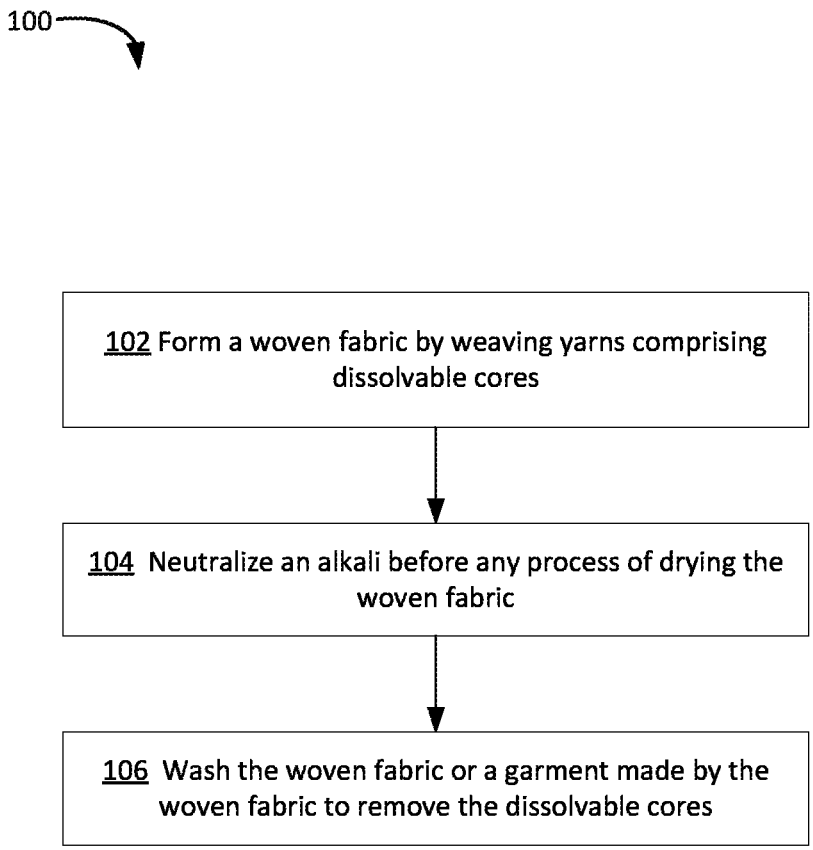
FIG. 1 is a flowchart illustrating an example process of producing an article in accordance with the present disclosure.

FIG. 1 is a flowchart illustrating an example process 100 of producing an article in accordance with the present disclosure. As shown, at step 102, a woven fabric is formed by weaving yarns that comprise dissolvable cores. Woven fabrics are made of yarns interlaced in a regular order. Typically, woven fabrics include warp yarns that run lengthwise along the fabric and weft yarns that run across the length of the fabric. The weft yarns are interwoven with and generally perpendicular to the warp yarns. The yarns may be provided on a loom or weaving machine to form a woven fabric.

In some embodiments, the woven fabric is formed by yarns comprising dissolvable cores to be completely or partially removed. Hollow structures would be formed in the woven fabric after the dissolvable cores are removed. Due to the hollow structures, the woven fabric would have higher breathability, better resilience, and a softer hand, which provides consumers more comfort wearing experience while maintaining a less see-through feature. In the textile industry, there is a long-felt need to produce such woven fabrics having hollow structures.

Preferably, Water-soluble PVA is used for forming dissolvable cores of yarns (e.g., cellulose content type yarns). Water-soluble PVA fiber is a cotton-like synthetic fiber, and it is non-toxic and odorless after dissolving in water. Water-soluble PVA is a green environmental protection material and one of the synthetic fibers that could be produced without fossil base. Although water-soluble PVA appears to be an ideal material for forming dissolvable cores of yarns, the textile industry has failed to find a solution to use water-soluble PVA for producing a woven fabric having hollow structure. The primary problem is that PVA cores could not be removed from woven fabrics.

The inventor of the present disclosure has been dedicated to seeking a solution of successfully using yarns including PVA cores for producing woven fabrics with hollow structures for years. Contrary to conventional understandings that water-soluble PVA fibers are stable against relative high temperature, acid, and alkaline, the inventor has found that PVA would lose its water solubility under certain circumstances.

When a woven fabric is formed by weaving yarns, the woven fabric is discolored and full of impurities, seed particles and debris. To transform a woven fabric into useful textiles, the woven fabric typically needs to be processed. During development trials, the inventor of the present disclosure found that PVA features would be changed during processing the woven fabric. Alkalis are frequently used in textile production. PVA would lose its water solubility when woven fabrics are processed at relatively high temperature in an alkaline environment, such as in the processes of scouring, mercerizing, or dyeing woven fabrics.

For instance, PVA becomes insoluble when woven fabrics are processed at around 100 degree Celsius under alkaline circumstances. PVA also becomes insoluble in water over 100 degree Celsius in a high-pressure boiling point bath. Process adjustments and/or substitute methods are needed in woven fabric production using PVA whenever an alkali is used for processing woven fabrics at a temperature approximately equal to or greater than a boiling temperature of water.

Step 104 illustrates neutralizing an alkali before any drying process involved in production of the woven fabric. Alkalies are used in different processes of woven fabric production, such as mercerizing in fabric pretreatment, scouring, and stabilizing agent in reduction of reactive dye, vat dye, and sulfur dye. Neutralizing is deployed, instead of simply rinsing, before a drying process as to maintain water solubility character of PVA. The water-solubility of PVA is maintained during processing woven fabrics in a neutralized environment. Any weak acid, such as acetic acid, oxalic acid, or citric acid, may be used to neutralize the alkali. Preferably, the pH value of woven fabric is controlled in a range from 5 to 7.5.

To maintain the water solubility of PVA cores, other substitute methods may be adopted. For instance, some dyeing methods, such as reactive dye and sulfur dye, would be replaced by substitute dyeing methods that do not need alkaline environment and high temperature at the same time. In case that any desired color can be achieved only by reactive dyeing or sulfur dyeing, the PVA cores may be removed before the dyeing.

Step 106 illustrates washing the woven fabric or a garment made by the woven fabric to remove dissolvable cores and form hollow structure in the woven fabric. A washing time for removing dissolvable cores may vary among fabrics with different structures. In some embodiments, 5-10 minutes are needed to remove PVA dissolvable cores. In other embodiments, washing time needed for removing dissolvable cores may be significantly increased. For instance, when the woven fabric has a leg tube form, washing time may be increased to 40-50 minutes.

A washing time needed for removing dissolvable cores can be decreased by making some adjustments to the bath condition of washing. In some embodiments, the washing time may be significantly decreased by adding weak acid into the washing process. The weak acid may be any acid having a pH value ranged from 4.5 to 6.5. For example, adding an oxalic acid solution with a density of 0.05% into the washing process may facilitate removing PVA dissolvable cores and considerably reduce the washing time.

After dissolvable cores are removed, hollow structures are formed inside the woven fabric, which improves breathability, resilience, and comfortableness of the woven fabric. In addition, due to the hollow structures formed inside the woven fabric, there is no need to apply softener during washing any garments made by the woven fabrics. Alternatively, only a very limited amount of softener should be used during washing the garments. Otherwise, there would be a risk of losing fibers of yarns against abrasion, thereby impacting the durability of the garments.

In some embodiments, the woven fabric may be formed using stretch yarns. Three types of stretch yarns may be used in manufacturing of fabrics: synthetic covering stretch yarn, core spun stretch yarn, and dual core spun stretch yarn. Fabric made from synthetic covering stretch yarns has disadvantages, e.g., fabric hand is hot as synthetic material used, moisture absorption is low, also there are shinny 'grin-throughs' when warp yarn is using natural fibers or artificial fibers. Due to spun process fluctuations, dual core type spun yarns have obvious segments of filament exposures in splices of yarns and sometimes on yarn body as well. Such exposures of segments of filament cores are undesirable in apparel applications. Preferably, core spun yarns with good stretch recovery and without filament core exposure are used to form woven fabrics.

In some examples, a stretch yarn may comprise a covering sheath (e.g., covering sheath 1 as shown in FIGS. 2-7) and a composite core disposed inside the covering sheath. The composite core of the stretch yarn may comprise a main stretch core (e.g., main stretch core as shown in FIGS. 2-7) and the dissolvable core to be removed (e.g., dissolvable core 2 as shown in FIGS. 2-6).

Figure 7:
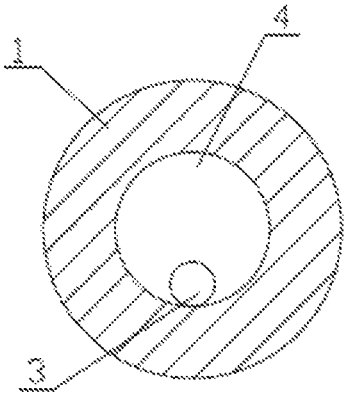
FIG. 7 is a cross section view illustrating an example of final hollow stretch yarn.

A hallow space (e.g., hollow space 4 as shown in FIG. 7) is formed inside the covering sheath and adjacent to the main stretch core after the dissolvable core is partially or completely removed, which provides the woven fabric a loose construction. Due to the loose construction, woven fabrics made with stretch yarns including dissolvable cores have higher breathability and softer hand, which provides consumers more comfort wearing experience as well as less see through effect.

Figure 2:
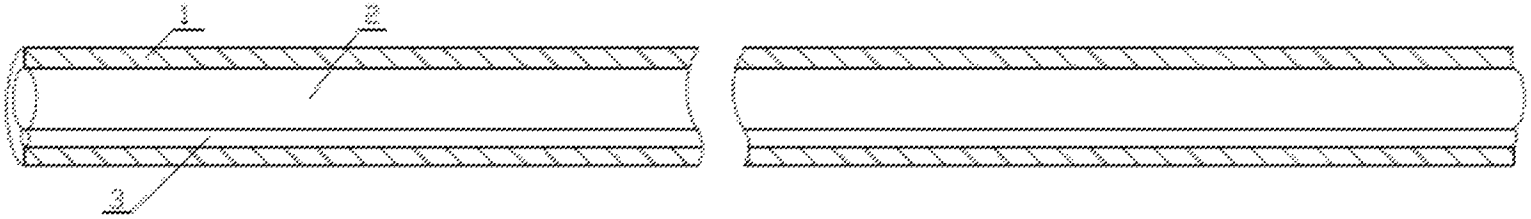
FIG. 2 is a vertical section view illustrating an example manner a composite core fed in parallel form.
Figure 3:
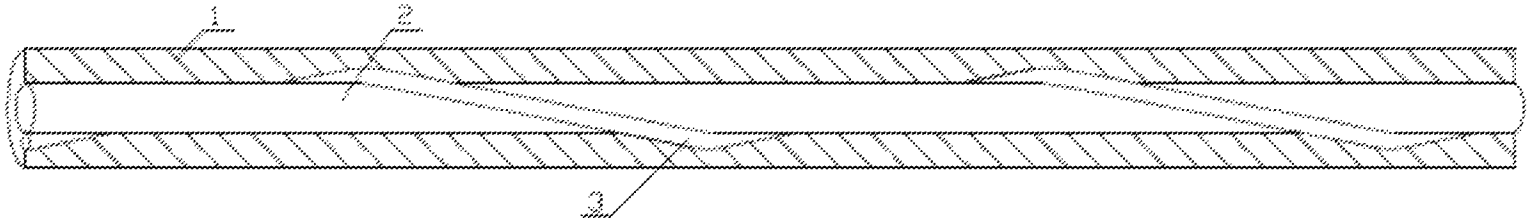
FIG. 3 is a vertical section view illustrating another example manner a composite core fed in ply yarn form.
Figure 4:
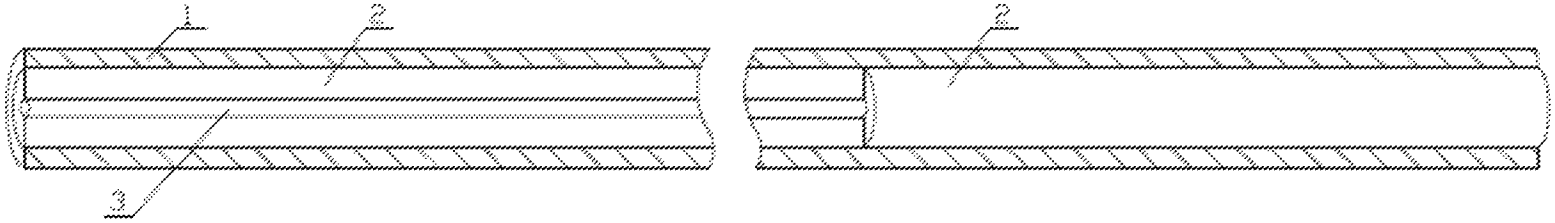
FIG. 4 is a vertical section view illustrating another example manner a composite core fed in core spun form.
Figure 5:
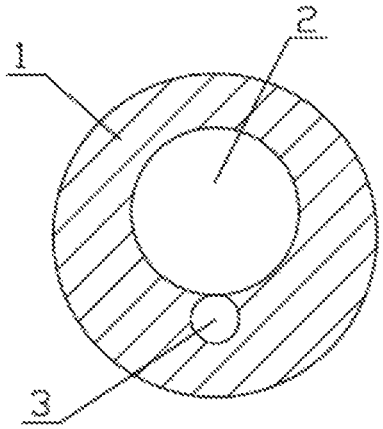
FIG. 5 is a cross section view corresponding to the vertical section views as shown in FIG. 2 and FIG. 3.
Figure 6:
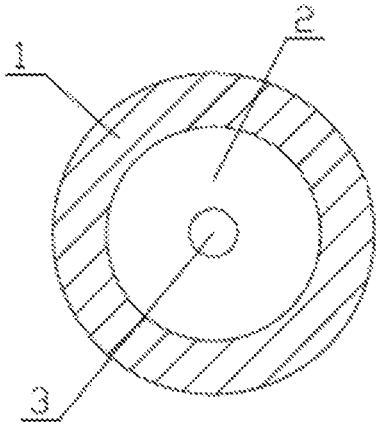
FIG. 6 a cross section view corresponding to the vertical section view as shown in FIG. 4.

In some examples, to produce a stretch yarn, there are multiple manners of placing a main stretch core and a dissolvable core. The main stretch core and dissolvable core may be fed in parallel form as shown in FIG. 2, may be fed in core spun (i.e., twisted) form as shown in FIG. 3, or may be fed in covered yarn form as shown in FIG. 4. Regardless of being fed in parallel form, core spun form, or in covered yarn form, the stretch yarn provides hollow space 4 as shown in FIG. 7 after the dissolvable core is removed, which allows the main stretch core to move and shrink in the yarn.

In addition, woven fabrics are preferably capable of springing back after stretching. A stretch yarn can provide a hollow tunnel space 7 as shown in FIG. 7 after the dissolvable core is removed, which enables the woven fabrics achieve prompt recovery after stretching.

The covering sheath of the stretch yarn forms an imperfect tube shape after the dissolvable core is removed, which results in a tiny path in the woven fabric. The tiny path significantly improves the breathability of the woven fabric formed by the stretch yarn. The final tube-like construction also improves a covering effect of the woven fabric and more efficient in light reflection, thereby achieving a less see-through result.

Drafting is a process of reducing linear density of a semi processed textile material as it passes through various machines used in making yarns. In some embodiments in accordance with the present disclosure, the yarns for producing the woven fabric are made with a drafting ratio in a range of 230%-350%. Preferably, lower end side is selected mostly for warp yarn (i.e., lengthwise yarn of woven fabric), while the higher end side is selected mostly for weft yarn (i.e., widthwise yarn of woven fabric).

Lower drafting ratio would result in thicker spandex, which is preferred for less damage of spandex by high temperature flame in singeing fabric processing. High flame temperature of singeing process would crystalize surface of spandex and thicker spandex would have more unaffected core to provide pulling force or stretch property stability. A low drafting ratio may also result in comparative lower shrinkage which would bring less impact on garment production. Meanwhile, a too low drafting ratio would affect consistency of spandex amount due to low pulling force during spinning process. Higher drafting ratio deployed in weft yarn mostly is due to commercial interest as well as more pulling force needed to accommodate normally lower weft density in fabric design.

In some examples, a size of a stretch yarn for forming woven fabrics is preferably in a range from 4 to 60 English cotton count. Yarns less than 4 English cotton count is not likely applicable for garment needs. In addition, a too thick yarn size does not align with a purpose of comfortability of woven fabrics and garments. Yarns greater than the finest end of 60 English cotton count will have a difficulty of covering by sheath on complex core in accordance with the present disclosure. Also, stretch yarns with a too fine yarn size would have technical barriers on splices control for hiding relaxed spandex ends.

In some embodiments, preferably, a weight of the dissolvable core is in a range from 10% to 40% of a total weight of the stretch yarn. A minimum weight ratio of the dissolvable core to the stretch yarn is approximately 10%, which enables to provide a hollow space after removing the dissolvable core so as to allow spandex to comparatively freely shrink after stressed. An increased weight ratio of the dissolvable core would result in a bigger hollow space formed in the stretch yarn, which makes the woven fabric formed by the stretch yarns to have better recovery and softer hand after the dissolvable cores are removed. However, the hollow space formed in the stretch yarn cannot be too big because a strength of the stretch yarn drops as the hollow space increases. Therefore, a maximum weight ratio of the dissolvable core is around 40%.

The various processes and features described above may be used independently of one another or may be combined in various ways. All possible combinations and sub-combinations are intended to fall within the scope of this disclosure. In addition, certain method or process blocks may be omitted in some implementations. The methods and processes described herein are also not limited to any particular sequence, and the blocks or steps relating thereto can be performed in other sequences that are appropriate. The example blocks or steps may be performed in serial, in parallel or in some other manner. Blocks or steps may be added to or removed from the disclosed example embodiments. The example components described herein may be configured differently than described. For example, elements may be added to, removed from, or rearranged compared to the disclosed example embodiments.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without author input or prompting, whether these features, elements, and/or steps are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

While certain example embodiments have been described, these embodiments have been presented by way of example only and are not intended to limit the scope of the inventions disclosed herein. Thus, nothing in the foregoing description is intended to imply that any particular feature, characteristic, step, module, or block is necessary or indispensable. Indeed, the novel methods and articles described herein may be embodied in a variety of other forms; furthermore, various omissions, substitutions and changes in the form of the methods and articles described herein may be made without departing from the spirit of the inventions disclosed herein. The accompanying claims and their equivalents are intended to cover such forms or modifications as would fall within the scope and spirit of certain of the inventions disclosed herein.

What is claimed is:

1. A method of producing an article having hollow structures, comprising:

weaving a plurality of yarns to form a woven fabric, wherein the plurality of yarns each comprise a dissolvable core, and the dissolvable core comprises a water-soluble polyvinyl alcohol (PVA);

neutralizing an alkaline processing environment before any process of drying to maintain the water-soluble PVA in the dissolvable core;

processing the woven fabric in the neutralized processing environment; and washing the woven fabric or a garment made by the woven fabric to at least partially remove the dissolvable core.

2. The method of claim 1, further comprising before the weaving a plurality of yarns to form a woven fabric, forming the plurality of yarns with a drafting ratio ranged from 230% to 350%.

3. The method of claim 1, wherein the plurality of yarns comprise at least one warp yarn formed with a first drafting ratio and at least one weft yarn formed with a second drafting ratio, and wherein the first drafting ratio is less than the second drafting ratio.

4. The method claim 1, wherein the neutralizing the alkaline processing environment further comprises neutralizing an alkali with a weak acid, and the neutralized processing environment has a pH value ranged from 5 to 7.5.

5. The method claim 1, wherein the neutralizing the alkaline processing environment before any process of drying further comprises neutralizing the alkaline processing environment before any process of drying during at least one process of scouring, dyeing, and mercerizing the woven fabric.

6. The method of claim 1, wherein the woven fabric has a tube structure.

7. The method of claim 1, further comprising:

adjusting a bath condition of washing to have an acidic bath with a pH value ranged from 4.5 to 6.5 so as to improve efficiency of removing the dissolvable core.

8. The method of claim 1, wherein the plurality of yarns each are a stretch yarn comprising a covering sheath and a composite core disposed inside the covering sheath, the composite core comprises a main stretch core and the dissolvable core, and a size of the stretch yarn is approximately in a range from 4 to 60 English cotton count.

9. The method of claim 8, wherein a weight of the dissolvable core before being at least partially removed is approximately in a range from 10% to 40% of a total weight of the stretch yarn.

10. The method of claim 8, wherein a hollow space is formed inside the covering sheath after the dissolvable core is at least partially removed.

11. An article having hollow structures, comprising:

a plurality of yarns woven to form a woven fabric, wherein the plurality of yarns each comprise a dissolvable core, the dissolvable core comprises polyvinyl alcohol (PVA) configured to maintain a water solubility throughout processing the woven fabric by processing the woven fabric in a neutralized alkaline processing environment before any process of drying, wherein the dissolvable core is configured to remain until after processing in the neutralized alkaline processing environment before any process of drying, and wherein the woven fabric or a garment made by the woven fabric thereof is configured to have the dissolvable core at least partially removed by a washing process thereof.

12. The article of claim 11, wherein the plurality of yarns are formed with a drafting ratio ranged from 230% to 350%.

13. The article of claim 11, wherein the plurality of yarns comprise at least one warp yarn formed with a first drafting ratio and at least one weft yarn formed with a second drafting ratio, and wherein the first drafting ratio is less than the second drafting ratio.

14. The article of claim 11, wherein the woven fabric has a tube structure.

15. The article of claim 11, wherein the plurality of yarns each are a stretch yarn comprising a covering sheath and a composite core disposed inside the covering sheath, the composite core comprises a main stretch core and the dissolvable core, and a size of the stretch yarn is approximately in a range from 4 to 60 English cotton count.

16. The article of claim 15, wherein a weight of the dissolvable core before being at least partially removed is approximately in a range from 10% to 40% of a total weight of the stretch yarn.

17. The article of claim 15, wherein a hollow space is formed inside the covering sheath after the dissolvable core is at least partially removed.

18. The article of claim 15, wherein the main stretch core and the dissolvable core are disposed in parallel with each other.

19. The article of claim 15, wherein the dissolvable core is twisted around the main stretch core.

20. The article of claim 15, wherein the main stretch core is covered by the dissolvable core.

* * * * *